United States Patent [19]

Tsutaki et al.

[11] 4,414,486

[45] Nov. 8, 1983

[54] COUPLED CAVITY TYPE TRAVELING WAVE TUBE

[75] Inventors: Kunio Tsutaki; Takao Kageyama, both of Tokyo, Japan

[73] Assignee: Nippon Electric Co., Ltd., Tokyo, Japan

[21] Appl. No.: 281,297

[22] Filed: Jul. 7, 1981

[30] Foreign Application Priority Data

Jul. 9, 1980 [JP] Japan ..... 55-93441

[51] Int. Cl.[3] ..... H01J 25/34

[52] U.S. Cl. ..... 315/3.6; 315/3.5; 315/5.35; 333/257

[58] Field of Search ..... 315/3.5, 3.6, 5.35, 315/39.3; 333/257

[56] References Cited

U.S. PATENT DOCUMENTS

| | | | |
|---|---|---|---|
| 3,123,736 | 3/1964 | Christoffers et al. | 315/3.6 |
| 3,181,023 | 4/1965 | Hant et al. | 315/3.5 |
| 3,636,402 | 1/1972 | Horigome | 315/3.6 |
| 4,019,087 | 4/1977 | Hamada et al. | 315/3.6 |
| 4,105,911 | 8/1978 | King et al. | 315/3.6 |
| 4,258,286 | 3/1981 | Kageyama | 315/3.6 |

FOREIGN PATENT DOCUMENTS

| | | | |
|---|---|---|---|
| 52-12557 | 1/1977 | Japan | 315/3.5 |

OTHER PUBLICATIONS

High-Power Traveling-Wave Tube YH 1041, a New Transmitter Tube for Satellite Radiocommunication. Reprint from "Siemens-Review" vol. XXXIV—Feb. 1967—No. 2 pp. 60 to 68 Authors: Karl Heintz and Erich Mayerhofer.

*Primary Examiner*—Saxfield Chatmon

*Attorney, Agent, or Firm*—Laff, Whitesel, Conte & Saret

[57] ABSTRACT

Two coupled cavity type, slow-wave circuits are separated, with a drift space section between them. An electron beam and an electromagnetic wave, which do not interact with each other, over a certain length, are in the drift space. A waveguide type non-reflective termination structure has a waveguide axis directed in the same direction as the electron beam and is coupled to the cavity, slow-wave circuits with respect to a high frequency wave disposed in the drift space section. With such a construction, a traveling wave tube is formed with a PPM focusing and with a non-reflective termination structure includes a waveguide member having a through-hole for passing an electron beam and two waveguides formed on the opposite sides of the through-hole. A lossy ceramic member is disposed within one of the two waveguides for a forwardly traveling wave and another lossy ceramic member is disposed in the other waveguide for a backwardly traveling wave. Each of the two waveguides has one end sealingly closed with tapered ceramic members of the forwardly traveling wave and for the backwardly traveling wave secured on the respective waveguide walls. During its propagation, an electromagnetic wave is perfectly absorbed by the lossy ceramic members.

15 Claims, 5 Drawing Figures

COUPLED CAVITY TYPE TRAVELING WAVE TUBE

BACKGROUND OF THE INVENTION

The present invention relates to a coupled cavity type traveling wave tube, and more particularly to a structure of a non-reflective termination for a slow-wave circuit in such tube.

Generally, a coupled cavity type traveling wave tube is composed of an electron gun for projecting and forming an electron beam. An electromagnetic wave interacts with the electron beam and is amplified in a coupled cavity type slow-wave circuit. A non-reflective termination means divides the slow-wave circuit with respect to a high frequency wave for the purpose of preventing oscillation. A collector captures electrons which have finished their interaction with the electromagnetic wave and dissipates heat energy. A focusing device is used for maintaining the diameter of the electron beam at a certain fixed size along the slow-wave circuit.

An electromagnet or a periodic permanent magnet (PPM) has been used as a focusing device in a coupled cavity type traveling wave tube. However, the focusing device employing the PPM is more often utilized because it is compact, light in weight and does not need a power supply for excitation as would an electromagnet. However, the PPM used as a focusing device in a coupled cavity type traveling wave tube has a number of shortcomings. The greatest shortcoming is that the magnetic field strength necessary for focusing an electron beam to a certain fixed diameter is essentially determined by the inner diameter of pole pieces in the PPM. When independently forming a PPM for a coupled cavity type slow-wave circuit, the inner diameter of the pole pieces in the PPM is limited by the diameter of the cavities in the coupled cavity type slow-wave circuit. Hence it is difficult to obtain the magnetic field strength necessary for focusing an electron beam.

It is particularly difficult to obtain the necessary magnetic field strength at an input waveguide section for guiding an input electromagnetic wave to the coupled cavity type slow-wave circuit; at an output waveguide section for externally deriving an electromagnetic wave from the coupled cavity type slow-wave circuit; and at a non-reflective termination section for severing the coupled cavity type slow-wave circuit with respect to a high frequency wave. This is because one or or more of the magnets of the PPM must be omitted. The problems at the input and output waveguide section may be avoided by the technique disclosed, for example, in the copending U.S. patent application Ser. No. 137,799 filed on Apr. 7, 1980. However, the problem at the non-reflective termination section heretofore remained unsolved.

One approach in the prior art for avoiding the omission of a magnet of a PPM at the non-reflective termination section, that is, for avoiding imperfection of a PPM at the non-reflective termination section, is disclosed in Siemens Review, Vol. 34, No. 2, p-p. 60–68. Particularly as shown at FIG. 1, two wedge-shaped lossy ceramic bodies are disposed to form a non-reflective termination for a forwardly traveling wave. Two similar bodies are disposed to form a non-reflective termination for a backwardly traveling wave. These wedge-shaped lossy ceramic bodies are disposed so as to extend over a plurality of cavities to improve matching characteristics. However, this approach has at least one shortcoming in that the lossy ceramic bodies are placed within resonant cavities. As a result the impedance of the circuit varies largely and hence it is difficult to achieve proper matching.

According to another approach disclosed in U.S. Pat. No. Re. 25,329, especially in FIG. 2 thereof, two lossy bodies have a cross-sectional configuration which is the same as the shape of the coupling hole in the slow-wave circuit, disposed in one cavity. One is provided for a forwardly traveling wave and the other for a backwardly traveling wave. In this approach, it is difficult to obtain good matching characteristics since the impedance of the slow-wave circuit changes largely abruptly due to the lossy bodies.

SUMMARY OF THE INVENTION

It is, therefore, one object of the present invention to provide a coupled cavity type traveling wave tube having a slow-wave circuit in which a magnet of a PPM is not omitted at a non-reflective terminations section, thereby improving the matching characteristics.

According to a feature of the present invention, two coupled cavity type slow-wave circuits are separated to provide therebetween a drift space section where an electron beam and an electromagnetic wave do not interact with each other over a certain length. A waveguide type non-reflective termination structure having a waveguide axis is directed in the same direction as the electron beam. The termination structure is coupled to the coupled cavity type slow-wave circuits with respect to a high frequency wave disposed in the drift space section. With such a construction, one can obtain a coupled cavity type traveling wave tube of a PPM focusing type provided with a non-reflective termination that is well impedance-matched.

The wave-guide type non-reflective termination structure preferably comprises a waveguide member having a through-hole for passing an electron beam and two waveguides formed on the opposite sides of the through-hole. A lossy ceramic member for a forwardly traveling wave is disposed within one of the two waveguides, and a lossy ceramic member for a backwardly traveling wave is disposed in the other waveguide. It is further preferred that each of the two waveguides have one end sealingly closed. The tapered ceramic members for the forwardly traveling wave and for the backwardly traveling wave are securely fixed on the respective waveguide walls. An electromagnetic wave entering the waveguide from its open end is perfectly absorbed by the lossy ceramic members during its propagation. A typical example of the lossy ceramic is carbon-containing beryllia. The length of the lossy ceramic member differs depending upon the frequency to be used, and is preferably about one wavelength. For instance, in the case of a traveling wave tube for a 14 GHz band, it has a length of 15 to 20 mm.

DESCRIPTION OF PREFERRED EMBODIMENTS

Figure 1:
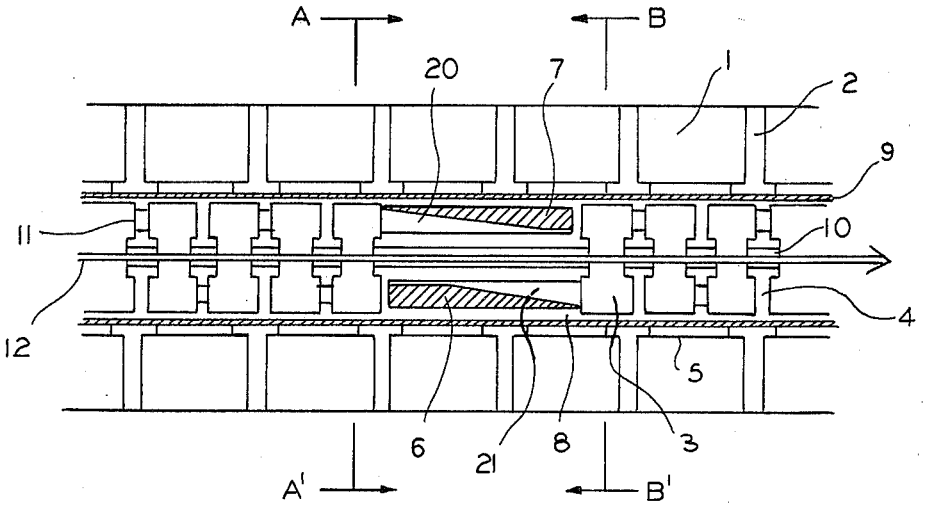
FIG. 1 is an axial cross-sectional view showing a non-reflective termination section in a coupled cavity type slow-wave circuit according to a first preferred embodiment of the present invention.

Referring now to FIG. 1, a non-reflective termination structure in a coupled cavity type traveling wave tube, according to the present invention, is illustrated in axial cross-section. The constructions of the remaining sections other than the non-reflective termination section of the coupled cavity type traveling wave tube are identical to those of the heretofore known tubes. Therefore, illustration and description of the remaining sections will be omitted here.

In FIG. 1, a plurality of resonant cavities 3, having through-holes 10 for passing an electron beam, are coupled to each other within a vacuum envelope 9 to form a slow-wave circuit. At the midpoint of this slow-wave circuit is disposed a waveguide member 8 provided with electromagnetic wave absorbers (lossy ceramic bodies) 6 and 7 to form a non-reflective termination. Reference numerals 4 and 5 designate partition walls and outer circumferential walls, respectively, of the resonant cavities 3. Electromagnetic wave coupling holes 11 are formed in the respective partition walls 4 so that an electromagnetic wave travels from the left to the right (as viewed in FIG. 1) through those coupling holes 11. Along the outer circumference of the vacuum envelope 9 is periodic magnetic field device (PPM) in which permanent magnets 1 and pole pieces 2 are alternately arrayed, for focusing an electron beam 12.

The non-reflective termination structure will be described next in greater detail with reference to FIGS. 2 and 3 which show cross-sections taken along lines A–A′ and B–B′, respectively, in FIG. 1. The non-reflective termination is composed of a waveguide member 8 and lossy ceramic members 6 and 7. The waveguide member 8 comprises a copper member having a circular cross-section with a through-hole for passing an electron beam at its center. Waveguides 20 and 21 are formed on opposite sides, along the through-hole. The through-holes have substantially the same cross-sectional configuration as the electromagnetic wave coupling holes 11 between the cavities 3 (see FIG. 1) and extending in the axial direction of the tube. One waveguide 20, for a forwardly traveling wave in the waveguide member 8, is closed at the right end. The other waveguide 21 for a backwardly traveling wave is closed at the left end. The lossy ceramic member 6 for the backwardly traveling wave is mounted within the waveguide 21, and the lossy ceramic member 7 is mounted within the waveguide 20.

Assume now that as viewed in FIG. 1, the left side is an electron gun (not shown) side and the right side is a collector (not shown) side. An electron beam 12 traveling from the electron gun side through the through-holes 10, for passing the electron beam 12, interacts with the electromagnetic wave traveling through the electromagnetic wave coupling holes 11 between the cavities 3, with the travel being from the left to the right. As a result the electron beam 12 is modulated, while the electromagnetic wave is amplified. The electromagnetic wave arriving at the non-reflective termination enters into the waveguide 20 where it encounters and is entirely absorbed by the lossy ceramic member 7, which is provided for the forwardly traveling wave. Although the amplified electromagnetic wave is entirely absorbed by this non-reflective termination, the electron beam 12 passing through the non-reflective termination has already been modulated by the amplified electromagnetic wave. It induces an electromagnetic wave in the resonant cavities 3 behind the non-reflective termination. The excited electromagnetic wave is again amplified by the interaction with the electron beam 12. The amplified electromagnetic wave is eventually derived at the output, through an output waveguide (not shown).

An impedance mismatching exists at the output end generates a backwardly traveling electromagnetic wave propagating from the collector side to the electron gun side. However, this backwardly traveling electromagnetic wave (that is, the reflected wave) is also entirely absorbed by the lossy ceramic member 6, when is provided expressly as a non-reflective termination for the backwardly traveling wave within the waveguide 21. As described above, a non-reflective termination is always composed of a non-reflective termination for a forwardly traveling wave and a non-reflective termination for a backwardly traveling wave.

In the illustrated embodiment, the non-reflective termination formed of the lossy ceramic member 7 and the waveguide 20 is the non-reflective termination for the forwardly traveling wave. The other non-reflective termination formed of the lossy ceramic member 6 and the waveguide 21 is the non-reflective termination for the backwardly traveling wave.

These two non-reflective terminations are disposed at circumferentially offset positions. The lossy ceramic member 7 for the forwardly traveling wave and the lossy ceramic member 8 for the backwardly traveling wave 6 are joined to the respective waveguides 20 and 21 on their respective sides of the vacuum envelope 9 by an alloying process so as to effectively disipate the heat generated by the non-reflective termination to the outside.

Figure 2:
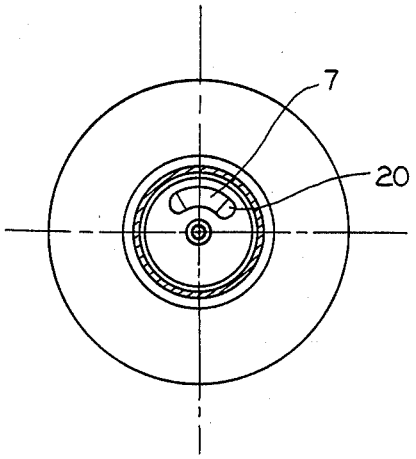
FIGS. 2 and 3 are cross-sectional views taken along line A–A′ and line B–B′, respectively, in FIG. 1 as viewed in the direction of arrows.
Figure 3:
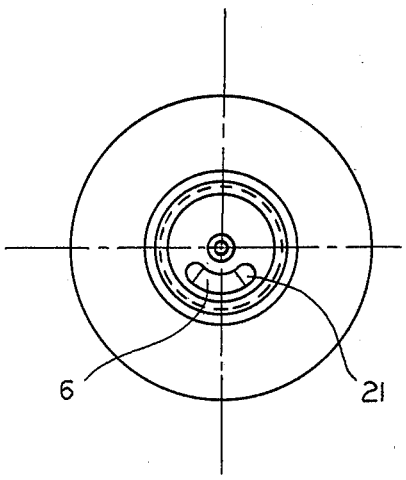

The open ends of the waveguides 20 and 21 in the non-reflective termination are respectively illustrated in FIGS. 2 and 3. The non-reflective termination can be, impedance-matched with the slow-wave circuits, if the configuration of the open end is identical to that of the electromagnetic wave coupling hole 11 in the partition walls 4 of the resonant cavities 3. As a result a non-reflective termination of a coupled cavity type traveling wave tube, having excellent impedance-matching characteristics, can be constructed without modifying the structure of the resonant cavities 3 in the proximity of the non-reflective termination. Good matching is possible even if the cross-sectional configurations of the open ends of the waveguides 20 and 21 in the non-reflective termination are somewhat different from those of the partition walls 4 with the electromagnetic wave coupling holes 11. It is possible to realize impedance-matching by slightly modifying the configurations of the electromagnetic wave coupling holes 11 in the neighborhood of the non-reflective termination.

Carbon-containing beryllia is effective for use as the lossy ceramic used in the non-reflective termination. The length of the lossy ceramic member is equal to about one wavelength. Therefore, the length of the lossy ceramic member differs depending upon the frequency of the electromagnetic wave for which the tube is to be operated. In the illustrated traveling wave tube that is operable in the 14 GHz band, the length is in the range of 15 mm to 20 mm.

The most remarkable advantage of the present invention is that the non-reflective termination formed by arranging two waveguides 20 and 21 and mounting lossy ceramic members 7 and 6 therein, can be disposed entirely within the vacuum envelope 9. Obviously, as a result of this advantage, in a coupled cavity type traveling wave tube employing the non-reflective termination of this invention, there is no need to omit one or more of a plurality of magnets. Hence, the focusing of an electron bean can be achieved more perfectly. The non-reflective termination can also be effectively used in a traveling wave tube employing an electromagnet.

Figure 4:
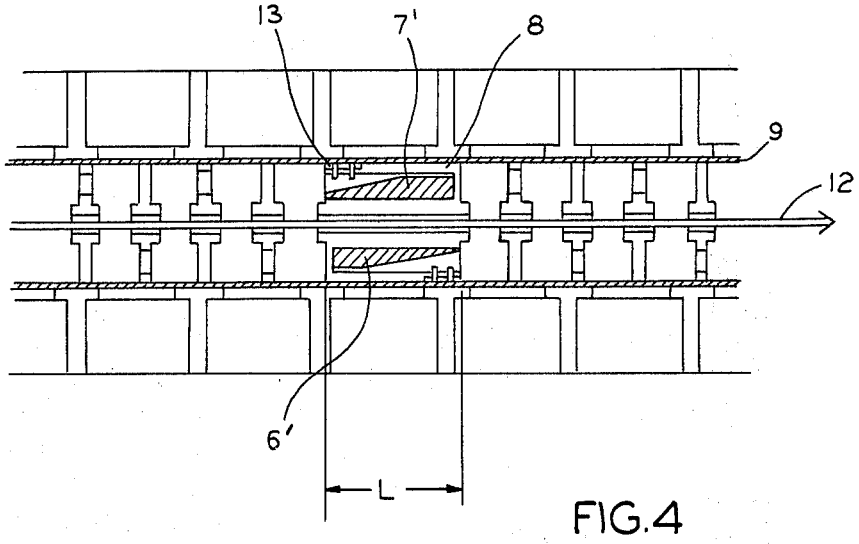
FIG. 4 is an axial cross-sectional view showing a second preferred embodiment of the present invention.

FIG 4, shows another preferred embodiment of the present invention, where it is schematically illustrated in cross-section. In this embodiment, reference numeral 13 designates metal rods to be used for impedance-matching.

In general, as a non-reflective termination to be used in a coupled cavity type traveling wave tube, it is desirable for the length L to be as small as possible. However, if the length L is made too small, the impedance-matching characteristics would deteriorate.

In this modified embodiment, a lossy ceramic member 7' for a forwardly traveling wave and a lossy ceramic member 6' for a backwardly traveling wave are joined to a waveguide member 8, along its side faced to an electron beam 12. The metal rods have adjustable lengths and are disposed in the wall of the waveguide member 8 on the side of the vacuum envelope 9. Even when the length L of the non-reflective termination is relatively small, a good impedance-match can be realized by adjusting the lengths of the metal rods 13.

Figure 5:
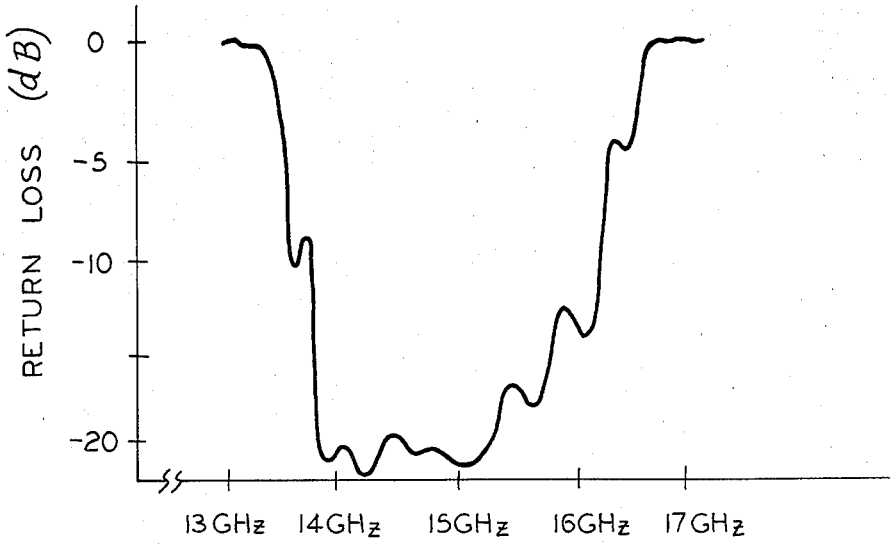
FIG. 5 is a diagram showing a reflection characteristic of the non-reflective termination according to the present invention.

A reflection characteristic of the non-reflective termination constructed according to the first preferred embodiment (FIG. 1) of the present invention is shown in FIG. 5. The operating frequency is indicated in GHz along the abscissa and the loss of electromagnetic energy caused by reflection from the slow-wave circuit and non-reflective termination, that is (the so-called "return loss") is indicated in dB along the ordinate. As will be seen from FIG. 5, the non-reflective termination formed according to the present invention can operate over a fairly large bandwidth with a small return loss. For example, the disclosed non-reflective termination can operate from 14 to 16 GHz with a return loss not greater than about −15 dB. It can operate from 14 to 15 GHz with a return loss not greater than about −20 dB.

As described in detail above, the present invention provides a novel coupled cavity type traveling wave tube having a non-reflective termination, which has excellent impedance-matching characteristics to slow-wave circuits and which facilitates PPM focusing of an electron beam.

What is claimed is:

1. A coupled cavity type traveling wave tube having an electron gun and a collector, said tube comprising a plurality of coupled cavity type slow-wave circuit means, a first and second of said coupled cavity type slow-wave circuit means being mounted with separation to provide therebetween an electron beam drift space, two non-reflective waveguides elongating in the direction parallel to an axis of said tube along said electron beam drift space and disposed on opposite sides of said electron beam drift space to sandwich said electron beam drift space therebetween, and an electron beam focusing device having a plurality of permanent magnets and a plurality of pole pieces which are alternately and periodically arrayed in the direction parallel to said axis of said tube to continuously cover said first slow-wave circuit means, said two non-reflective waveguides, and said second slow-wave circuit means without omission of any magnet, one of said non-reflective waveguides being coupled to said first slow-wave circuit means and the other being coupled to said second slow-wave circuit means with respect to a high frequency wave.

2. The coupled cavity type traveling wave tube as claimed in claim 1, in which one or more impedance-matching metal rods are disposed on the wall surfaces of said waveguides.

3. The coupled type traveling wave tube as claimed in claims 1 or 2, in which said non-reflective waveguides are provided with lossy ceramic members therein.

4. The coupled cavity type traveling wave tube as claimed in claim 3, in which said lossy ceramic member is made of beryllia containing carbon.

5. The coupled cavity traveling wave tube according to claim 3 wherein the lossy ceramic members are tapered to receive and guide a traveling wave.

6. The coupled cavity traveling wave tube according to claim 3 wherein the length of the lossy ceramic members is approximately equal to the wavelength of the wave amplified by the tube.

7. The coupled cavity traveling wave tube according to claim 1 wherein the non-reflective termination is disposed within a vacuum envelope.

8. The coupled cavity traveling wave tube according to claim 1 which is further comprised of partition walls defining electromagnetic wave coupling holes and wherein the non-reflective waveguide means has an open end with a configuration substantially identical to that of the coupling hole.

9. A traveling wave tube comprising a vacuum chamber enclosing a plurality of axially aligned resonant cavity means surrounding a through hole for passing an electron beam, waveguide means positioned at approximately the middle of said through hole, electromagnetic wave absorbing means disposed in said waveguide means to form a non-reflective termination for said electron beam, and periodic magnetic field means for focusing said beam and magnetic means comprising a full complement of permanent magnets distributed along the length of said beam.

10. The device of claim 9 wherein said absorbing means comprises an opposing pair of wedge-shaped lossy ceramic bodies oriented in opposite directions to separately terminate a forwardly traveling electron beam and a backwardly traveling reflected wave.

11. The device of claim 10 wherein said pair of ceramic bodies are disposed in circumferentially offset positions.

12. The device of claim 9 and at least one electromagnetic wave coupling hole in at least one of said resonant cavities in the vicinity of said non-reflective termination, the configuration of said coupling hole controlling an impedance-matching characteristic of said cavity.

13. The device of claim 12 wherein a plurality of said cavities have said impedance-matching coupling holes.

14. The device of 12 wherein said non-reflective termination has a length in a range approximating the wave length of a traveling wave in said tube.

15. The device of claim 12 and at least one metal rod in the vicinity of said traveling wave to tune and match impendance of said tube.

* * * * *